United States Patent [19]

DeMent, Jr.

[11] 4,111,418

[45] Sep. 5, 1978

[54] PEG BOARD GAME APPARATUS AND METHOD OF PLAYING GAMES THEREWITH

[76] Inventor: Hill D. DeMent, Jr., 742 Horton, Fort Scott, Kans. 66701

[21] Appl. No.: 765,828

[22] Filed: Feb. 4, 1977

[51] Int. Cl.[2] ..... A63F 3/00; A63B 23/04

[52] U.S. Cl. ..... 273/1 R; 35/73; 272/96; 273/282; 273/285; 273/287; 273/289

[58] Field of Search ..... 273/1 R, 1 E, 1 M, 273/130–137, 94 R; 40/2 R, 2 A, 20 R, 130 AC, 131 AC, 131 B, 131 BA, 132, 134 G, 134 GM, 135 B, 135 BC, 136 C, 136 E, 137 AC, 137 AD; 272/96; 35/73

[56] References Cited

U.S. PATENT DOCUMENTS

| | | | |
|---|---|---|---|
| 868,209 | 10/1907 | Muller | 273/136 E |
| 1,503,294 | 7/1924 | Bishop | 273/94 R |
| 1,673,705 | 6/1928 | Pesnel | 273/137 AD |
| 2,100,421 | 11/1937 | Wupper | 273/136 C X |

FOREIGN PATENT DOCUMENTS

| | | | |
|---|---|---|---|
| 738,291 | 12/1932 | France | 273/136 D |
| 481,848 | 9/1929 | Fed. Rep. of Germany | 273/136 G |

OTHER PUBLICATIONS

*Living With a Disbility* Howard A. Rusk and Eugene J. Taylor pp. 77 –78, 9–1954.

*Primary Examiner*—Paul E. Shapiro
*Attorney, Agent, or Firm*—Fishburn, Gold & Litman

[57] ABSTRACT

A peg board game apparatus is self-supporting in use and self contained in storage and includes a hinged, multi-sectional peg board and a plurality of toe tabs or game pieces, each having an oblong, planar base with a peg receiving aperture therein and a planar grip, suitable for toe gripping by a child. The toe tabs and peg board faces are contrasting colors, and the tabs and pegs are labeled by sequential indicia. Rules are provided for playing games involving manipulation of the toe tabs about the pegs by gripping the tabs with the toes.

9 Claims, 8 Drawing Figures

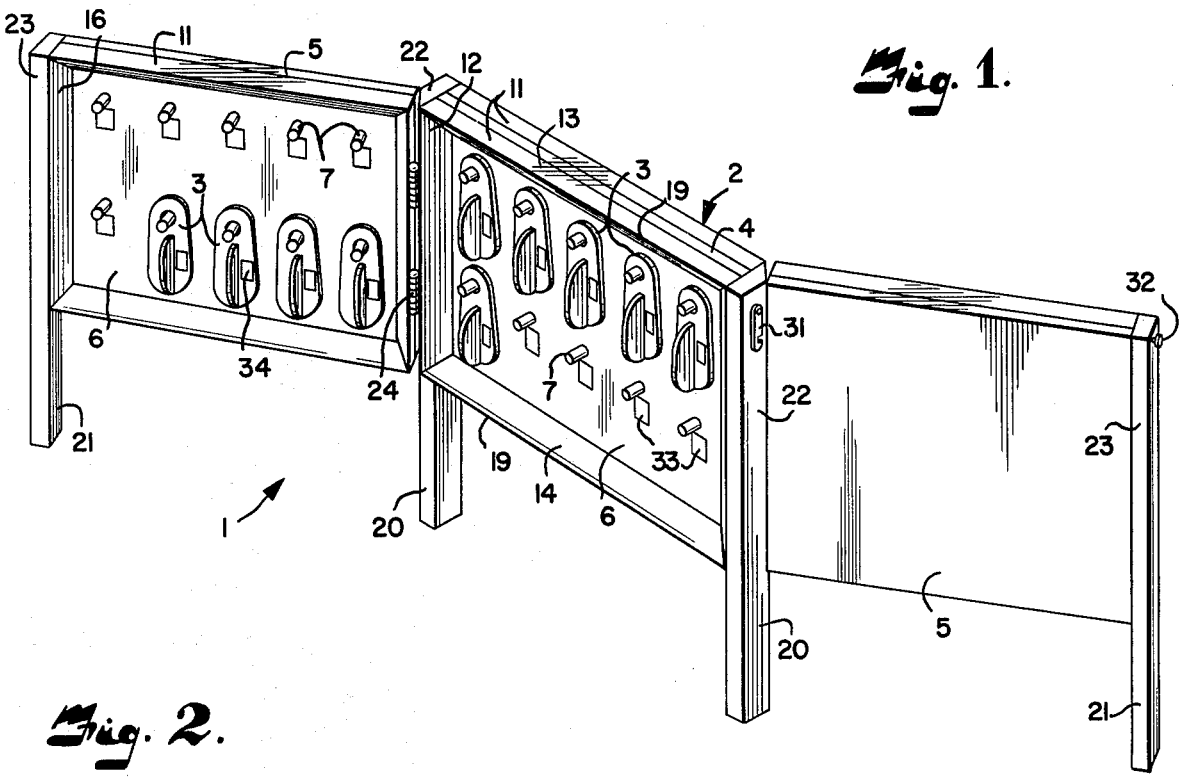
Fig. 1.
Fig. 2.
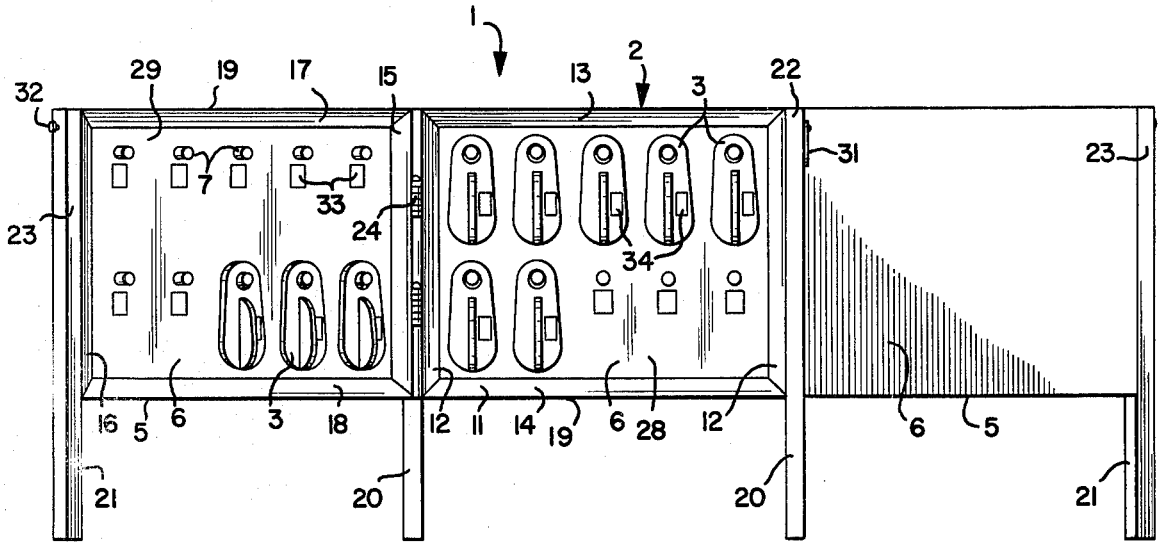
Fig. 3.
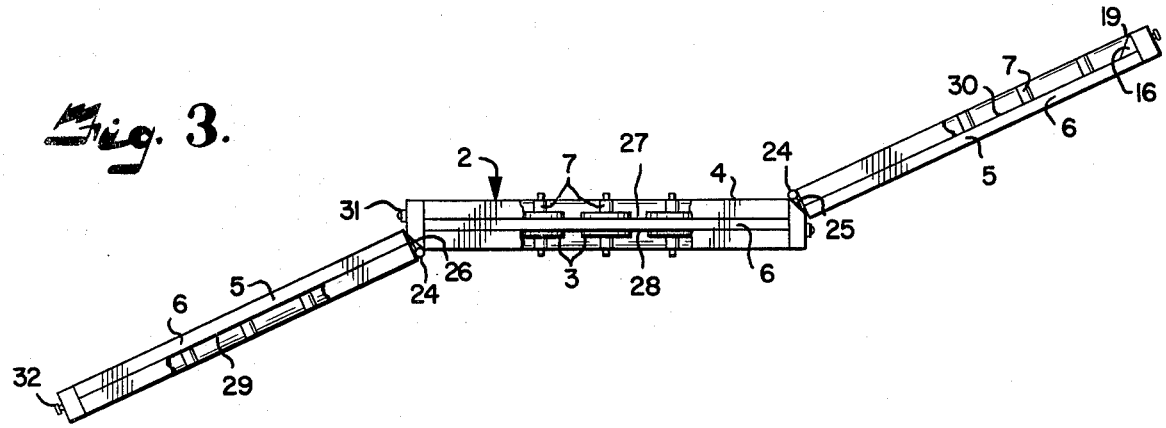

PEG BOARD GAME APPARATUS AND METHOD OF PLAYING GAMES THEREWITH

The present invention relates to educational and exercise games and more particularly to a peg board game apparatus of which game pieces are gripped by the toes for transferring from the pegs of one section of the peg board to another.

The game apparatus of the present invention is intended primarily for use by children and, in a preferred form, involves the transfer of game pieces by gripping same with the toes from a sitting position. The gripping of objects with the toes, while not a necessary or important skill in itself, does promote development and coordination of the muscle groups of the lower legs. The transfer of the game pieces by the feet from a sitting position exercises the muscles of the upper legs and the abdomen. In addition to exercise, the methods and apparatus of the present invention give the players practice in the recognition of symbols and sequences thereof, which is a useful aid in the education, especially, of younger children.

The principal objects of the present invention are: to provide an apparatus for playing a peg board game in which game pieces are gripped by the toes for transfer about a peg board; to provide such a game apparatus, having a plurality of hinged sections, which is self-supporting and which may be folded and latched for storage; to provide such a game apparatus having pegs which abut corresponding pegs on other panels when the apparatus is folded, for retaining the game pieces on the pegs; to provide such a game apparatus having means for reducing tendencies of the board to collapse during use; to provide such a game apparatus wherein colored game pieces are used on a contrasting colored board; to provide such a game apparatus and methods of playing games therewith which are competitive and entertaining and which develop physical dexterity and promote team cooperation; to provide such a game apparatus having particular appeal to children; to provide such a game apparatus and method of playing games therewith which teach a child recognition of and distinctions between colors, numbers, and sequences of numbers; and to provide such a game apparatus which is economical to manufacture, attractive in appearance, durable and safe in use, and which is particularly well adapted for its intended purpose.

Other objects and advantages of this game will become apparent from the following description taken in connection with the accompanying drawings wherein are set forth, by way of illustration and example, certain embodiments of this invention.

The drawings constitute a part of the specification, include an exemplary embodiment of the present invention, and illustrate various objects and features of the peg board game apparatus.

FIG. 1 is a perspective view of the game apparatus shown in playing position.

FIG. 2 is an elevational view of the peg board in a playing position and showing the layout of pegs on faces thereof.

FIG. 3 is a top plan view of the peg board in playing position with portions broken away to show the locations of pegs thereon.

Figure 4:
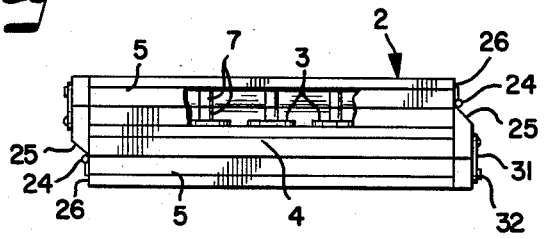
FIG. 4 is a top plan view of the peg board in a closed position with portions broken away to show the mutual contact of corresponding pegs on adjacent panels.
Figure 5:
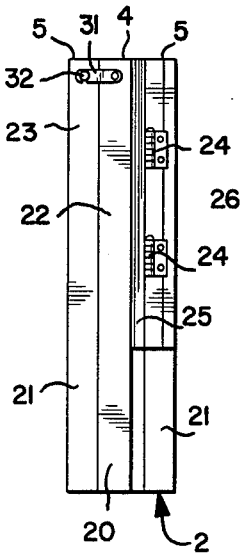
FIG. 5 is an end elevational view showing the peg board in a closed position.
Figure 6:
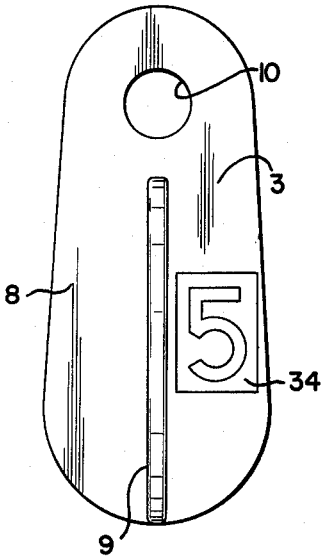
FIG. 6 is an enlarged front elevational view of one of the game pieces of the present invention.
Figure 7:
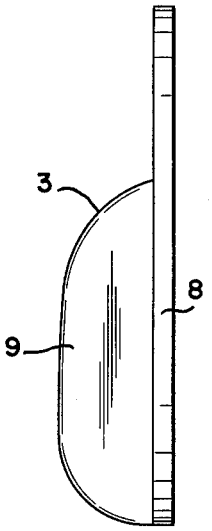
FIG. 7 is an enlarged side elevational view of the game piece.
Figure 8:
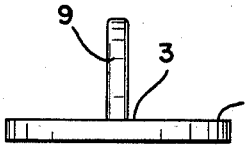
FIG. 8 is an enlarged end elevational view of the game piece.

Referring to the drawings in more detail:

The reference numeral 1 generally designates a peg board game apparatus including a peg board assembly 2 and a plurality of toe tabs or game pieces 3. The peg board assembly 2 generally comprises a center section 4 and a pair of wing sections 5 hingedly joined together at respective side edges thereof. Each section has a panel 6 with a plurality of pegs 7 projecting from at least one face thereof. The toe tabs 3 respectively have a generally planar base 8 and a gripping portion 9 projecting therefrom. A peg receiving aperture 10 is formed at one end of the base 8.

In a preferred embodiment, the peg board panels 6 are rectangular and each is surrounded by a supporting frame 11 which may consist of frame members joined to the edges of the panel 6. The center section 4 has a pair of side frame members 12, upper frame members 13 and lower frame members 14. Each wing section 5 has an inner side frame member 15, an outer side frame member 16, an upper frame member 17, and a lower frame member 18. The support frames 11 provide mounting structures for the panels 6 and, in the illustrated peg board, offer some degree of protection for the pegs 7 since the panels 6 are mounted in a recessed manner such that the pegs 7 of each panel do not project past a plane containing respective protective edges 19 of the frame members.

The peg board 2 is adapted for use with the panels 6 in vertical planes. In order to position the panels 6 at a comfortable height above a supporting surface (not shown), the center section 4 includes a pair of legs 20, and each wing section 5 includes a leg 21. In the illustrated embodiment, the center section legs 20 are extensions of elongated members 22 attached to the side frame members 12 and projecting past the lower frame member 14 of the center section 4. Similarly, each wing section 5 includes an elongated member 23 joined to the outer side frame member 16 thereof and projecting past the lower frame member 18 thereof.

Hinge members 24 attach the center section side frame members 12 to the inner side frame members 15 of the wing sections 5 for pivoting the wing sections 5 between fully opened positions for playing games thereon (FIG. 3) and a closed position for storage (FIG. 4). The hinges 24 are positioned at opposite, diagonally spaced corners of the center section 4, and in the closed position, the wing sections 5 cover opposite faces of the center section 4.

For reasons of safety, it is desirable to limit pivoting of the wing sections 5 to less than 180°. If the wing sections 5 opened a full 180°, the peg board 2 would have a tendency to collapse, possibly injuring a player or, at least, disrupting a game. Therefore, as illustrated in FIGS. 3 and 4, a bevel 25 is formed on each elongated member 22 of the center section 4. The bevels 25 are located at opposite, diagonally spaced corners of the center section 4 and are positioned adjacent the hinges 24. The bevels 25 are adapted to be engaged by the outer surfaces 26 of the inner side frame members 15 of the wing sections 5 when the wing sections are pivoted toward an open position. Preferably, the bevels 24 are formed at such an angle that the wing sections 5 may be opened to an angle of not more than about 155° with respect to the center sections 4.

As illustrated, there are pegs 7 on both surfaces 27 and 28 (See FIG. 3) of the center section panel and on one surface of each wing section panel. Preferably, the pegs 7 are located on the surfaces 29 and 30 respectively of the wing sections 5 which are internal when the respective wing section is pivoted into a closed position (see FIG. 4). The pegs 7 may be arranged in any pattern on the panels 6, as long as there is adequate spacing for the game pieces to be placed on the pegs 7. FIG. 2 illustrates a preferred pattern having two rows of five pegs each.

Means are provided for retaining the toe tabs 3 on the pegs 7 when the peg board 2 is folded into a closed position. The pegs 7 on each wing section 5 are of such a length whereby the free ends thereof abut corresponding pegs 7 on the center section 4 when the wing sections 5 are pivoted to a closed configuration. Preferably, the pegs 7 are about three-fourths of an inch long, and, likewise, the panels 6 of each section are recessed to a depth of three-fourths of an inch behind the plane containing the protective edges 19.

A latch 31 is provided on both sides of the center section 4 for retaining the wing sections 5 in the closed position. The latches 31 engage catches 32 on the wing section elongated members 23. When the toe tabs 3 are placed on the pegs 7 and the wing sections 5 closed and latched, the peg board game apparatus 1 presents a self-contained package that may be conveniently stored with no danger of losing parts thereof.

The toe tabs or game pieces 3 are adapted for manipulation by means of the toes, especially by children. The toe tabs 3 must be light and properly balanced and also durable. They should present a comfortable grip and must not have sharp edges that would present hazards to children. They may be constructed from suitable material, such as plastic or wood, and processed in such a way so as to insure the aforementioned criteria.

Preferably, the surfaces 27 and 30 are one color and the surfaces 28 and 29 are a different color. The sets of toe tabs 3 to be used with each panel pair (27, 30 and 28, 29) are a color different from the panel pair they are to be used with.

Since the game apparatus 1 is intended to be educational, the pegs 7 of each panel surface are labeled by symbolic indicia 33 such as numerals, letters, or other symbols. The toe tabs 3 for each panel pair are labeled with symbolic indicia 34 corresponding to the indicia of the pegs of one of the panel surfaces.

The present invention includes methods of playing a number of games using the peg board game apparatus 1. In all games below described, the toe tabs 3 are intended to be gripped by the toes of the players for manipulation of the tabs from the pegs 7 of one panel 6 to another, although the tabs 3 could be hand gripped for manipulation thereof.

In a game for two players, the ten toe tabs 3 of one set are placed on the pegs 7 of the face 29 and another ten are placed on the face 30. Each of the players sits facing one of the adjacent board surface pairs, one player facing the surfaces 28 and 29, the other facing the surfaces 27 and 30. A start signal is given, such as one player exclaiming "Toe!" and the other responding with "GO!". At that instant, the competition begins. Each player moves the toe tabs 3 from the pegs on wing panel surfaces 29 and 30, one at a time, to the pegs of the center panel surfaces respectively 28 and 27. The toe tabs 3 are gripped with the toes only. If a tab 3 is dropped, it may only be picked up with the toes. When one of the players has moved all of his toe tabs, he signals the end of the game by saying "Toe Go!" and is the winner. The signals described are suggestions. Any suitable method of signaling may be used, or, alternatively, a third person may be employed as a referee.

One variation of the game described above is for each player to use only 1 foot for moving the toe tabs throughout a game, for example, only the right foot throughout a game, or only the left foot. Another variation is for each player to remove the tabs 3 with one foot, for example, the left foot, pass the tab to the right foot, and then place the tab on the peg of the center panel surface with the right foot.

In the described games, it is not necessary for either the pegs 7 or the toe tabs 3 to be labeled with the respective indicia 33 and 34, although the indicia would not be a hinderance. However, the present invention also includes methods of playing games for which the toe tabs 3 and the pegs 7 of at least the center section surfaces 27 and 28 must be labeled. Initially, the sets of tabs 3 are placed on the wing section pegs 7 in random sequences. Each player faces an adjacent pair of panel surfaces 27 and 30 or 28 and 29. When the start signal is given, each player grips a tab 3 and removes it from his wing section surface and places it on the peg 7 of the respective center section surface having the same indicia 33 as the indicia 34 of the tab 3 being moved. The first player to transfer all of his tabs from his wing section surface to his center section surface in the proper order is the winner.

In a variation of the previously described game, each player places the tabs 3 on the pegs of the respective wing section surface according to a sequence written out by his opponent prior to the start signal of each game.

The peg board game apparatus 1 may also be used in games involving more than two players, for example, four. In one of the games involving four players, teams of two each are formed. The players of one team sit facing adjacent panel surface pairs, such as surfaces 28 and 29 respectively, while the players of the opposing team sit facing the panel surfaces 27 and 30, respectively. The toe tabs 3 of each set are placed on one of the panel surface pairs, such as the wing surfaces 29 and 30.

A start signal is given. Each player facing a wing section surface, 29 or 30, grips a tab 3, removes it from its peg 7 and transfers it to the toes of his partner, who then places the tab 3 on one of the pegs 7 of the respective center panel surface 28 or 27. The team correctly transferring all of the toe tabs 3 of its center panel surface first is the winner.

In another game for four players, the initial placement is as follows. One of the players of one team sits facing the wing panel surface 29 while his partner sits facing away from the center panel surface 28. On the opposing team, one of the players sits facing the wing panel surface 30 while his partner faces away from the center panel surface 27. The sets of pegs are placed respectively on the wing panel surfaces 29 and 30.

After the start signal is given, each of the players facing the wing panel surfaces 29 and 30 grips a toe tab 3, removes it, and spins around 180° before transferring his respective tab to his partner. The partner then spins around 180° to place the tab on the peg 7 on the respective center section surface. Each player on a team returns to his original position before the next tab is transferred. The winning team is the one to transfer all the tabs 3 from its wing surface to its center surface.

In still another game playable by four, a player of one team sits facing one of the center panel surface 27 or 28. The other member of each team sits facing one of the wing panel surface, however, members of the same team are on opposite sides of the peg board 2. For example, one team consists of the players facing the panel surfaces 28 and 30, while the other team consists of the players facing the surfaces 27 and 29. The sets of toe tabs 3 are initially placed on the center panel surfaces 27 and 28. At the start signal, each of the players facing the center panel surfaces 27 and 28 removes a tab 3 and reaches under the respective wing panel surface 29 or 30 and transfers the tab to his teammate who then places the tab on his respective wing panel surface. The procedure is repeated by each team until one team succeeds in transferring all of their tabs.

While certain forms of this invention have been illustrated and described, it is not to be limited thereto except insofar as such limitations are included in the following claims.

What is claimed and desired to be secured by Letters Patent is:

1. A method of playing a game by at least two players using a peg board having at least one peg projecting therefrom and at least one game piece having a peg receiving aperture and a gripping portion capable of being grasped between human toes, said method comprising the steps of:

(a) one player grasping said game piece by said gripping portion between the toes of one foot and moving said game piece from a first position off said peg;

(b) said player transferring said game piece to the toes of another player; and (c) said other player moving said game piece to a second position with said peg projecting through said aperture.

2. The method as set forth in claim 1 wherein said peg board is spaced from a supporting surface with a clearance space therebelow and said other player is positioned on the opposite side of said peg board from said first named player, said method including the step of:

(a) said first named player placing said game piece gripping foot under said peg board before transferring said game piece to said other player.

3. A game apparatus comprising:

(a) a game piece having a base with a side, an aperture extending through said base, and a toe gripping portion projecting from said base;

(b) a peg board comprising:

(1) a center panel having opposite surfaces, a lower edge, and opposite side edges, (2) a wing panel having opposite surfaces, a lower edge, and opposite side edges, (3) hinge means joining one of said wing panel side edges to one of said center panel side edges for pivoting said wing panel between a fully open position and a closed position with said wing panel in covering relation to one of said center panel surfaces, and (4) each of said panels having a plurality of pegs projecting from at least one surface thereof, each of said pegs being receivable through said game piece aperture for selectively supporting said game piece; and (c) means for limiting said pivoting to an obtuse angle.

4. The game apparatus as set forth in claim 3 wherein said means for limiting said pivoting includes:

(a) a bevel on said one center panel side edge; and (b) an abutment surface on said one wing panel side edge and engageable with said center panel bevel.

5. A game apparatus comprising:

(a) a game piece having a base with a side, an aperture extending through said side, and a toe gripping portion projecting from said base;

(b) a peg board including a pair of panels, each panel having opposite surfaces and side edges;

(c) hinge means joining one side edge of each of said panels together for pivoting said panels between a fully open position and a closed position with one panel in covering relation to the other panel; and (d) a plurality of pegs on each of the surfaces of said panels which are facing when said panels are in said closed position, each of said pegs being receivable through said game piece aperture; and (e) said pegs being of such length and relative position whereby the pegs on one panel abut corresponding pegs on the other panel when said panels are in said closed position.

6. A game apparatus comprising:

(a) a plurality of game pieces, each game piece having a base with a side, an aperture extending through said side, and a toe gripping portion projecting from said base;

(b) a peg board including a center panel and a pair of wing panels, each of said panels having opposite surfaces, a lower edge, and opposite side edges;

(c) hinge means joining one side edge of each wing panel to one of said center panel side edges for pivoting each wing panel between a fully open position and a closed position with said wing panel in covering relation to one of said center panel surfaces; and (d) a plurality of pegs projecting from both of said center panel surfaces and from one surface of each of said wing panels, each of said pegs being receivable through the aperture of one of said game pieces.

7. The game apparatus as set forth in claim 6 wherein said pegs on said wing panel surfaces are on the surface of each wing panel which faces one of said center panel surfaces when said wing panel is in said closed position.

8. The game apparatus as set forth in claim 7 wherein said center panel pegs and said wing panel pegs are of such a length and have such relative positions that pegs on each wing panel abut corresponding pegs on said center panel when said wing panel is pivoted into said closed position.

9. The game apparatus as set forth in claim 6 wherein:

(a) said center panel has a pair of legs extending from the lower edge thereof; and (b) said wing panel has a leg extending from the lower edge thereof.

* * * * *